US007205956B1

(12) United States Patent
Sychaleun et al.

(10) Patent No.: US 7,205,956 B1
(45) Date of Patent: Apr. 17, 2007

(54) STRUCTURAL WAVEGUIDE FORMED IN A LEG OF AN ANTENNA TOWER AND METHOD OF USE

(75) Inventors: Somsack Sychaleun, Kanata (CA); Gregory Carleton, Ottawa (CA); Steve Beaudin, Nepean (CA)

(73) Assignee: Nortel Networks Limited, St. Laurent, Quebec (CA)

( * ) Notice: Subject to any disclaimer, the term of this patent is extended or adjusted under 35 U.S.C. 154(b) by 11 days.

(21) Appl. No.: 11/010,374

(22) Filed: Dec. 14, 2004

(51) Int. Cl.
*H01Q 1/22* (2006.01)
*H01P 3/12* (2006.01)

(52) U.S. Cl. ..... 343/890; 343/891; 333/248

(58) Field of Classification Search ..... 343/890, 343/891, 840; 333/248
See application file for complete search history.

(56) References Cited

U.S. PATENT DOCUMENTS 2,945,231 A * 7/1960 Scheldorf ..... 343/800
3,573,836 A * 4/1971 Ajioka et al. ..... 343/777
3,609,603 A * 9/1971 Lutchansky ..... 333/239
3,864,688 A * 2/1975 Hansen et al. ..... 343/756
4,868,639 A * 9/1989 Mugiya et al. ..... 257/699
5,905,474 A * 5/1999 Ngai et al. ..... 343/840
6,026,627 A * 2/2000 Moore ..... 52/651.02
6,047,199 A 4/2000 DeMarco

OTHER PUBLICATIONS

Dielectric IB-174-E P/N 43966 Installation Instructions for (DTW) Doubly Truncated Waveguide Dielectric Communications, 22 Tower Road, Raymond, ME 04071 Revised Aug. 2003.

* cited by examiner

*Primary Examiner*—Benny Lee

(57) ABSTRACT

A communications tower, or other structure is provided with at least one waveguide defined in a structural support. The waveguide can be used to transmit signals up and down the communications tower thereby eliminating at least some cabling.

20 Claims, 5 Drawing Sheets

STRUCTURAL WAVEGUIDE FORMED IN A LEG OF AN ANTENNA TOWER AND METHOD OF USE

FIELD OF THE INVENTION

The application relates to a structure and method for transmitting and receiving radio frequency signals.

BACKGROUND OF THE INVENTION

A typical layout of a cellular base station system includes a base station adjacent the ground connected to the public switched telephone network (PSTN) and multiple antennas located at an elevated position on a support structure. The antennas are connected to the base station by a plurality of lengthy coaxial cables which extend from the base station adjacent the ground to the antennas at their elevated position. The weight of the coaxial cables is supported by the support structure.

There are many disadvantages in the use of coaxial cables to connect the base station and the antennas. First, the weight of the coaxial cables requires the support structure to have greater structural strength than otherwise would be required. Second, coaxial cables degrade when exposed to the elements and accordingly require relatively frequent replacement. Third, coaxial cables are susceptible to service interruptions from lightening strikes. Fourth, there is unwanted signal degradation resulting from the transmission of signals over coaxial cables. Fifth, coaxial cables are costly.

One solution to address the disadvantages of coaxial cables is to shorten the length of the coaxial cables by mounting a transceiver, which is normally found in the base station, at the top of the support structure with the antennas. However, it has been found that transceivers mounted at the top of support structures require frequent and costly maintenance rendering the solution uneconomical.

SUMMARY OF THE INVENTION

A broad aspect of the invention provides a structural support having a generally elongated interior, the elongated interior defining at least one waveguide suitable for transmitting communication signals.

In one embodiment of the invention, the structural support is segmented and the segments are coupled such that each waveguide is continuous. The segments may terminate in flanges by which successive segments are connected.

In a further embodiment, the structural support is hermetically sealed.

An embodiment of the invention further comprises a first waveguide adapter at a first location on the structural support and a second waveguide adapter at a second location spaced apart from the first location on the structural support wherein the waveguide extends between the first and second locations and the first and second waveguide adapters are operable to transform signals to and from waveguide signals. The first and second waveguide adapters may be operable to mate with coaxial cables.

In a further embodiment, the structural support further comprises a waveguide adapter at a first location on the structural support and a waveguide coupler at a second location spaced apart from the first location on the structural support wherein the waveguide extends between the first and second locations and the waveguide adapter is operable to transform signals to and from waveguide signals. An antenna may be provided and adapted to mate with the waveguide coupler.

In another embodiment, the structural support comprises a leg for a communications tower. The at least one waveguide of the leg may be dimensioned to carry a signal of 1700 to 2600 MHz.

The at least one waveguide of the leg may be a rectangular waveguide with an interior cross-section of 4.300 inches±0.005 inches by 2.150 inches±0.005 inches. The at least one waveguide of the leg may be a circular waveguide with an interior diameter of 4.511 inches±0.005 inches.

The leg can be used in a communications tower, in particular a cellular base station tower.

The communications tower may have legs with one or two waveguides defined therein.

Another broad aspect of the invention provides, a method of transmitting a signal from a first end of a structural support to a second end of the structural support comprising: transmitting the signal along a waveguide, suitable for transmitting communication signals, in an interior of the structural support from the first end to the second end, transforming the signal into a waveguide signal at the first end; and transforming the signal from the waveguide signal at the second end. The structural support may comprise a leg of a communications tower.

The method may further comprise receiving the signal at the first end from a public switched telephone network.

The method may also comprise radiating the signal from the second end.

A further broad aspect of the invention provides a method of providing a signal path through a structural support comprising: providing a waveguide, suitable for transmitting communication signals, in an interior of the structural support; and providing a signal adapter adjacent each end of the structural support. The structural support may comprise a leg of a communications tower.

BRIEF DESCRIPTION OF THE DRAWINGS

Preferred embodiments of the invention will now be described with reference to the attached drawings in which.

DETAILED DESCRIPTION OF THE PREFERRED EMBODIMENTS

Figure 1:
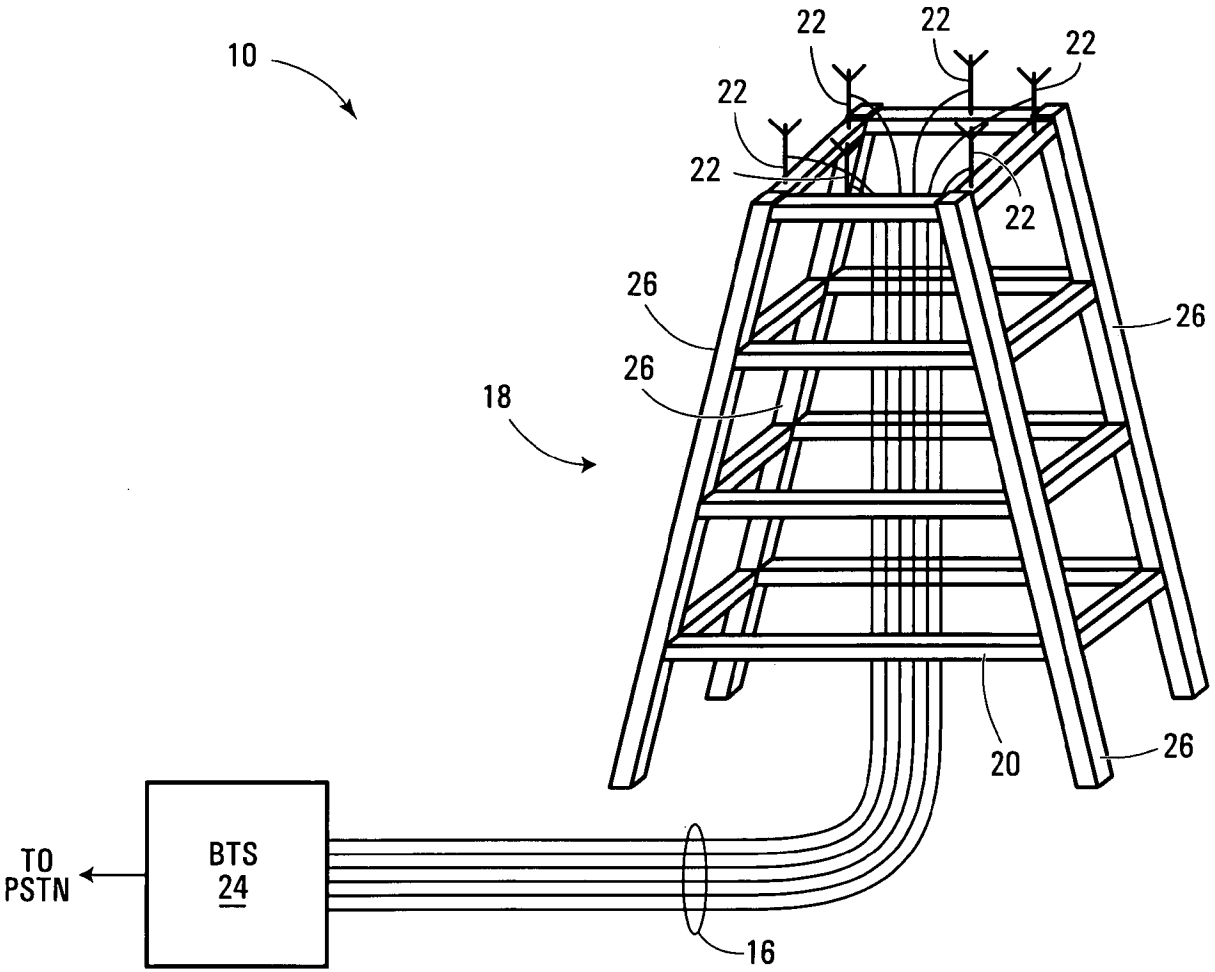
FIG. 1 (PRIOR ART)
FIG. 1 is a schematic representation of a cellular base station system according to the prior art.

FIG. 1 shows a cellular base station system 10 for receiving and transmitting cellular signals within a cellular network. The system 10 includes a base station (BTS) 24 and a tower 18. The tower 18 has inwardly-angled legs 26 which are interconnected by braces 20. At the top of the tower 18 are a plurality of antennas 22. The base station 24 receives signals from and transmits signals to the public switched telephone network (PSTN). The base station 24 also receives signals from and transmits signals to the antennas 22.

The connection of the base station 24 to the antennas 22 is made by a plurality of coaxial cables 16. Typically, the coaxial cables 16 extend up through an open center of the tower 18 and connect to the antennas 22. The coaxial cables 16 are fastened to and supported by the tower 18. The means of fastening the coaxial cables 16 to the tower 18 is not shown in FIG. 1. There is also typically an electrical power cable (not shown) extending from the base station to the top of the tower 18 to supply power to lights and other auxiliary equipment (not shown) which is mounted at the top of the tower 18.

The antennas 22 are mounted well above the ground at the top of the tower 18 to increase the range of the antennas 22 thereby decreasing the number of cells required within the cellular network. This requires that the tower 18 be a fairly tall structure. The result is that the coaxial cables 16 extend a significant distance between the base station 24 and the antennas 22. The disadvantage of this system, as noted previously, includes the weight of the coaxial cables 16 on the tower 18 and losses which result from the long length of the coaxial cables 16. There is an amplifier in the base station 24 in part, to compensate for the losses in the coaxial cables 16.

The antennas 22 include three receive only and three transmit/receive antennas. The system 10 operates to both transmit and receive signals. For transmission, the base station 24 receives signals from the PSTN. The signals are processed by the base station 24 and transmitted over the coaxial cables 16 to the transmit/receive antennas of the antennas 22. The transmit/receive antennas then radiate the signals. For signal reception, the antennas 22 receive signals and transmit the signals over the coaxial cables 16 to the base station 24. The base station 24 processes the signals and in turn transmits the signals to the PSTN.

Figure 2:
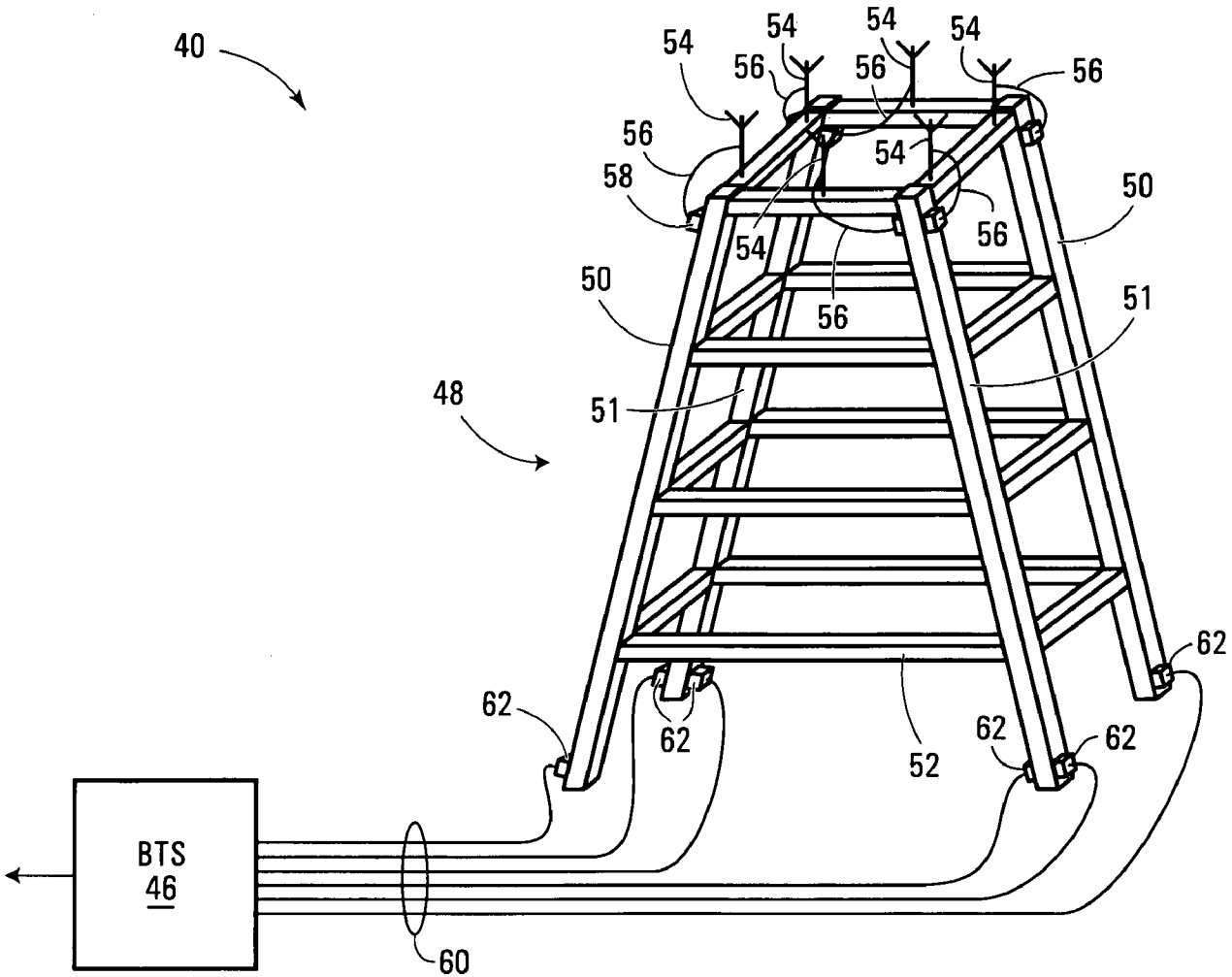
FIG. 2 is a schematic representation of a cellular base station system according to an embodiment of the present invention.

To address some of the problems associated with the use of coaxial cables, a cellular base station system 40 of FIG. 2 is provided that greatly reduces the use of coaxial cable. The system 40 includes a base station (BTS) 46 and a communications tower 48. The base station 46 includes equipment known in the art such as a transceiver, duplexers, a power amplifier, a low noise amplifier, backup batteries, air-conditioning systems, power-conditioning and/or signal-conditioning systems, and routers. One of the functions of the base station 46, as with the base station 24 of FIG. 1, is to amplify the signals. The amplifiers in the base station 46 may be of lower power than the amplifiers of the base station 24 of FIG. 1 because of the lower losses of the system 40 of FIG. 2 as will be further described below. There is also an electrical power cable (not shown) extending from the base station 46 to the top of the tower 18 to supply power to lights and other auxiliary equipment (not shown) which is mounted at the top of the tower 48.

The tower 48 has two inwardly-angled elongated supports or legs 50 and two inwardly-angled elongated supports or legs 51. An interior surface of each of the legs 50 defines one rectangular waveguide. An interior surface of each of the legs 51 defines two rectangular waveguides. Each of the legs 51 are internally subdivided to provide the two waveguides. The waveguides are intrinsic to the structural supports, i.e. load bearing members, which are legs 50, 51 of the tower structure. On each leg 50, adjacent the bottom of each leg 50, is a coaxial/waveguide adapter 62. On each leg 51, adjacent the bottom of each leg 51 are two coaxial/waveguide adapters 62 offset by 180° so that each of the coaxial/waveguide adapters 62 on each of the legs 51 connect to a different one of the two waveguides defined in the legs 51. The legs 50, 51 are interconnected by braces 52.

A plurality of coaxial cables 60 extend from the base station 46 to the coaxial/waveguide adapters 62. The coaxial/waveguide adapters 62 translate between the form of signals carried by the waveguides of the legs 50, 51 and the form of signals carried by the coaxial cables 60. Adjacent the tops of the legs 50, 51 are coaxial/waveguide adapters 58. At the top of the tower 48 are antennas 54. Each of the antennas 54 is connected to a coaxial/waveguide adapter 58 by a coaxial cable 56. As with the coaxial/waveguide adapters 62, the coaxial/waveguide adapters 58 translate between the form of signals carried by the waveguides of the legs 50, 51 and the form of signals carried by the coaxial cables 56.

In operation, the base station 46 receives communication signals from the PSTN. The signals are processed by the base station 46 and transmitted over the coaxial cables 60 to the coaxial/waveguide adapters 62. The coaxial/waveguide adapters 62 radiate the signals into the waveguides in the legs 50, 51. The signals are received by the coaxial/waveguide adapters 58 and transmitted over the coaxial cables 56 to the transmit/receive antennas of the antennas 54. The signals are then radiated by the transmit/receive antennas. For signal reception, the antennas 54 receive signals and transmit the signals over the coaxial cables 56 to the coaxial/waveguide adapters 58. The coaxial/waveguide adapters 58 radiate the signals into the waveguides in the legs 50, 51. The signals are received by the coaxial/waveguide adapters 62 and transmitted over the coaxial cables 60 to the base station 46. The base station 46 processes the signals and in turn transmits the signals to the PSTN. More generally, the signals may originate from other inputs and be transmitted to other outputs than the PSTN.

As can be seen from a comparison of FIG. 2 to FIG. 1, a significant length of coaxial cable has been eliminated from the configuration of FIG. 2. In FIG. 2, the length of coaxial cable which, in FIG. 1, extended up through the center of the tower 18, has been eliminated. Since waveguides typically have lower losses than coaxial cables, this allows for the amplifiers of the base station 46 of FIG. 2 to be lower power amplifiers than the amplifiers of the base station 24 of FIG. 1.

Although the tower 48 of FIG. 2 is depicted as having four inwardly-angled legs 50, 51 held together by braces 52, it will be appreciated by a person skilled in the art that any number of legs and any interconnecting and supporting arrangement known in the art can be used.

In the embodiment shown in FIG. 2, there is a one-to-one ratio between waveguides and antennas. Each of the six antennas is connected to a waveguide. Alternatively, only some of the antennas can be connected to waveguides. For example, the tower 48 could be dimensioned to also support two coaxial cables with each of the legs having only one waveguide for a total of six connections to the six antennas. Additional coaxial cables and antennas could also be added to the tower to increase the number of antennas which could be interconnected to the PSTN by the system 40.

Although it is preferred that all of the legs 50, 51 of the tower 48 have at least one waveguide defined therein, a waveguide may be provided in only some of the legs 50, 51.

FIG. 2 depicts legs 50, 51 having rectangular waveguides, but it will be understood by those skilled the art that other cross sectional shapes of legs defining other waveguide structures, such as circular, elliptical and ridge waveguides, are contemplated by this invention. In some embodiments, multiple signals are transmitted in a single waveguide using time and/or frequency division multiplexing. This allows more than one antenna to be connected to a single waveguide. This may be achieved by adding multiplexing equipment to the system 40 of FIG. 2 (not shown).

The exterior shape of the legs need not be consistent with the shape of the interior waveguide. It will also be understood that the exterior cross section of the legs 50, 51 may be tapered. The interior cross section remains preferably substantially uniform.

Figure 3A:
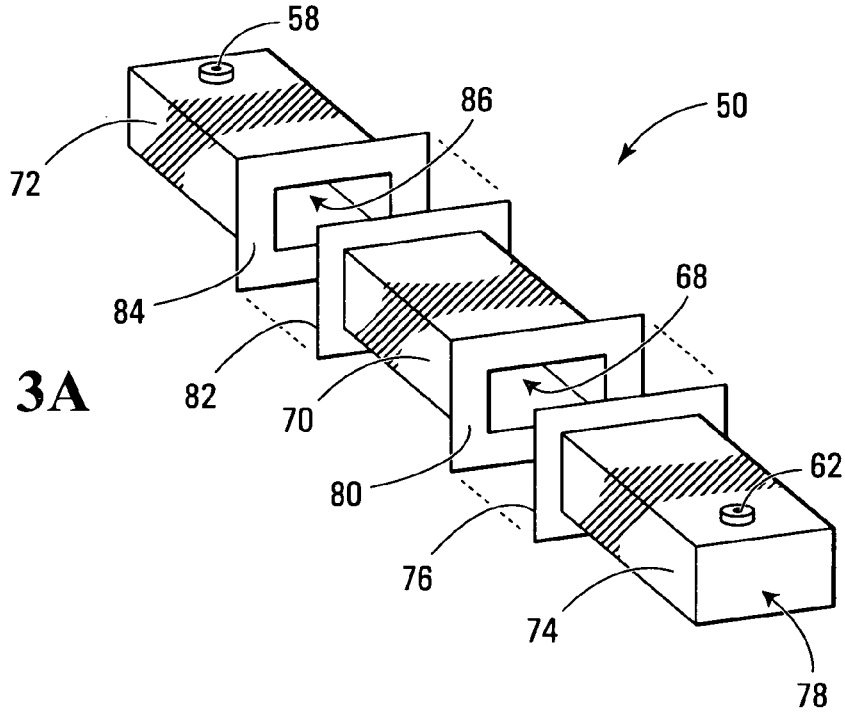
FIG. 3A is an exploded perspective view of a first structural support according to the embodiment of FIG. 2.

One of the legs 50 is shown in detail in FIG. 3A. A lower end of the leg 50 is a lower segment 74. The lower segment 74 is rectangular with a rectangular inner passageway. The bottom 78 of the lower segment 74 is solid. An upper end of the lower segment 74 terminates in a flange 76. The flange 76 is open to the interior of the lower segment 74. The coaxial/waveguide adapter 62 is mounted in the lower segment 74.

The leg 50 also has multiple intermediate segments 70 (one shown). The intermediate segments 70 are also rectangular with rectangular inner passageways 68 which have the same cross-sectional dimensions as the rectangular inner passageway of the lower segment 74. Each of the intermediate segments 70 also has an upper flange 82 and a lower flange 80. The rectangular inner passageway 68 of each intermediate segment 70 extends in uniform dimensions through the entirety of the intermediate segment 70 and extends through the lower flange 80 and the upper flange 82. At top of the leg 50 is an upper segment 72. The upper segment 72 has a closed top but has a flange 84 at its bottom with an opening to a rectangular inner passageway 86 which is continuous with the rectangular inner passageway 68 of the intermediate segments 70. The upper segment 72 has a coaxial/waveguide adapter 88.

The view of the leg 50 in FIG. 3A is an exploded view. In use, the segments 74, 70 and 72 are connected. This can be done by welding the segment together around the circumference of the flanges. In particular, flange 76 is welded to flange 80, successive flanges 80 and 82 of intermediate segments 70 are welded together and the top flange 82 of the uppermost of the intermediate segments 70 is welded to the flange 84 of the upper segment 72. Thus assembled, a continuous rectangular waveguide is defined through the leg 50.

Figure 3B:
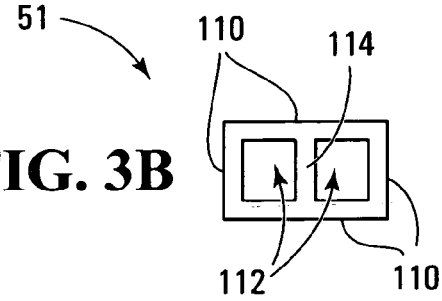
FIG. 3B is a cross-sectional view of a second structural support according to the embodiment of FIG. 2.

A cross-section of one of the legs 51 is shown in FIG. 3B. The leg 51 has an overall rectangular shape defined by four outer walls 110. An inner wall 114 joins two opposite outer walls 110 to define two rectangular waveguides 112 within the leg 51. Each segment of the leg 51 is preferably extruded in its entirety with inner wall 114 present. However, walls 110, 114 may alternatively be welded or otherwise joined in a manner known in the art. The legs 51 are otherwise configured and assembled in a similar manner to the legs 50.

Figure 3C:
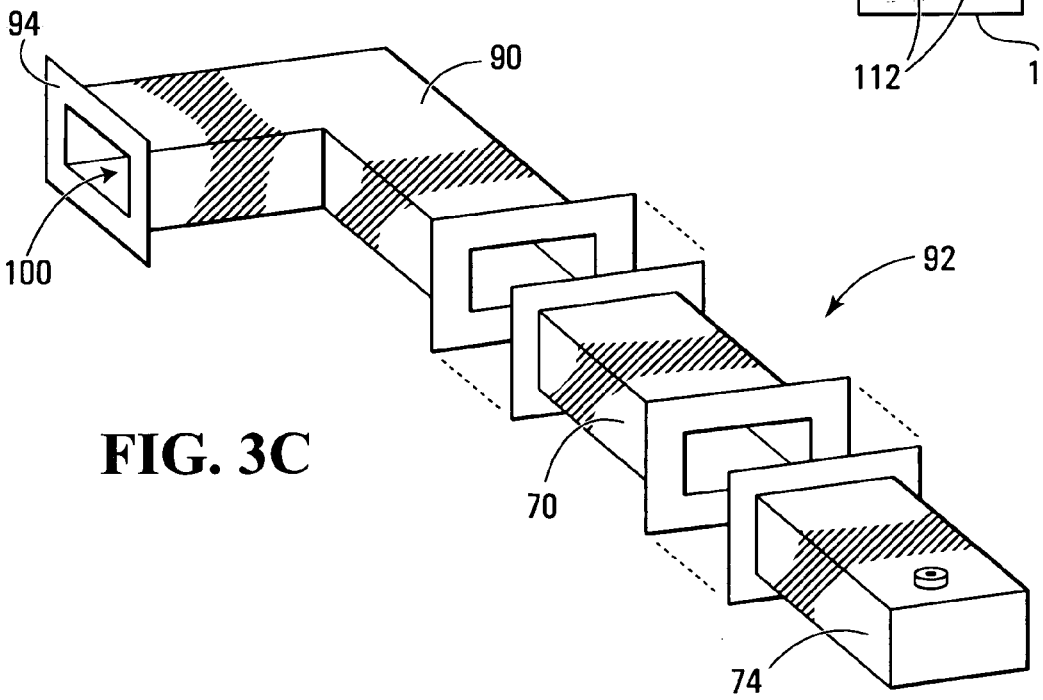
FIG. 3C is an exploded perspective view of a structural support according to a further embodiment of the invention.

A leg 92 is shown in FIG. 3C in accordance with an alternate embodiment of the invention. The leg 92 is made up of a lower segment 74 and intermediate segments 70 as described with respect to the leg 50 of FIG. 3A. However, the leg 92 has an upper segment 90 which is different from the upper segment 72 of the leg 50 of FIG. 3A. In particular, the upper segment 90 does not have a coaxial/waveguide adapter. Instead, the upper segment 90 terminates in a flange 94 which has defined therein an opening 100. As with the segments 70, 72 and 74 previously described, the interior of the upper segment 90 defines a waveguide. The flange 94 of the upper segment 90 is intended to connect directly to an antenna without the requirement for an intermediary length of coaxial cable. This is possible where the antenna at the top of the tower is adapted to connect directly to a waveguide.

Upper segment 90 also shows a right angle turn. The leg 92, and more generally the legs of the present invention may contain any number of turns as long as the waveguide nature of the interior of the legs is maintained. The upper segment 90 may even be eliminated from the leg 92 and instead a segment 70 may directly connect to an antenna if the antenna is adapted to attach to a waveguide of that orientation or to a flexible waveguide.

Typically, the legs of the present invention will be comprised of an aluminum alloy, galvanized zinc, galvanized steel or other material known in the art of waveguides. The interior surface of the legs will be preferably smoothed to a specified accuracy, for example to an accuracy of ±0.005 inches. The legs may be segmented as shown in FIGS. 3A and 3C in eight to ten feet length or extruded as single continuous legs which do not required segmentation. Also, the interconnection of segments may be realized by other means such as bolting or riveting.

The legs may be sealed or unsealed. Preferably, if the legs are completely sealed, they are hermetically sealed and pressurized to a low level, slightly above atmospheric pressure with an inert gas such as nitrogen. Alternatively, if the legs are not hermetically sealed, preferably small shielded holes are provided in the legs to allow air circulation and drainage.

The frequency range a waveguide transmits is determined by its dimensions. The frequency range for a cellular network is typically between 1700 and 2600 MHz. In an example implementation to achieve this range, the interior of the legs 50, 92 has a rectangular cross-section of 4.300 inches±0.005 inches by 2.15 inches±0.005 inches. Circular legs, to achieve a similar frequency range, have an interior diameter of 4.511 inches±0.005 inches. These are standard dimensions known in the art for commercial waveguides.

It will be understood that numerous modifications can be made to the legs of the tower of the present invention without deviating from the invention.

Figure 4A:
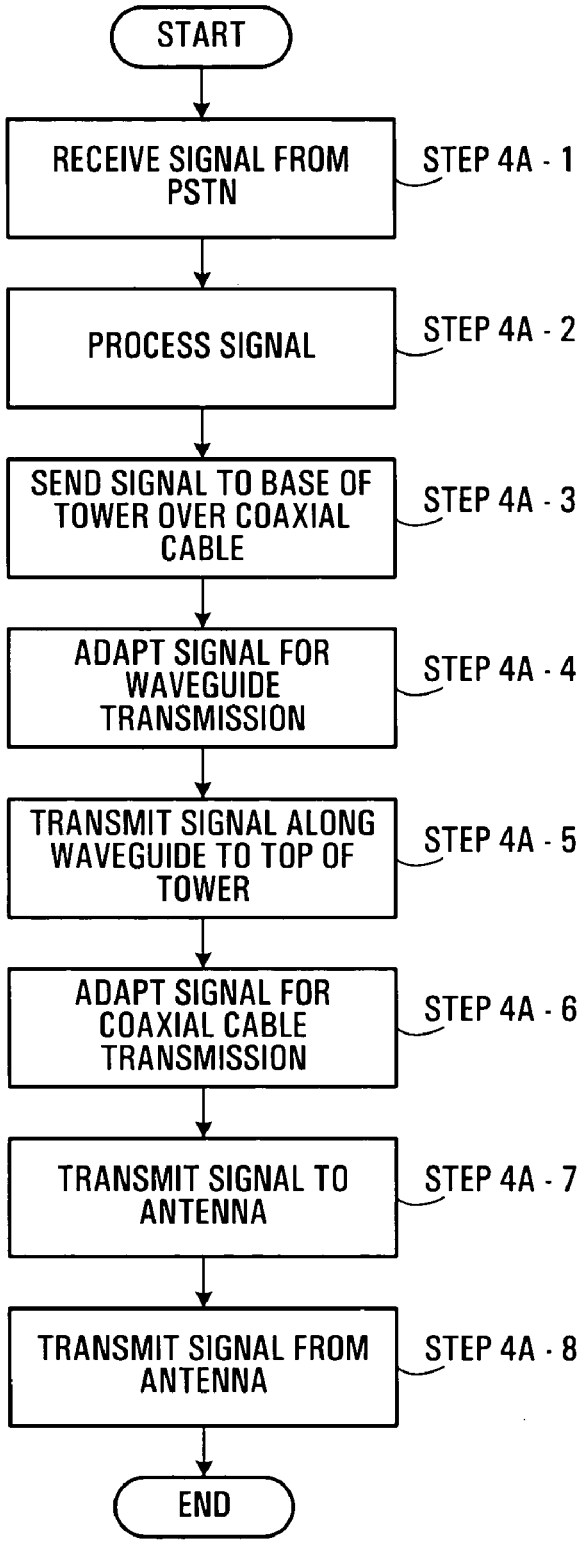
FIG. 4A is a flow diagram of the operation of the cellular base station system of FIG. 2 to transmit a cellular signal.
Figure 4B:
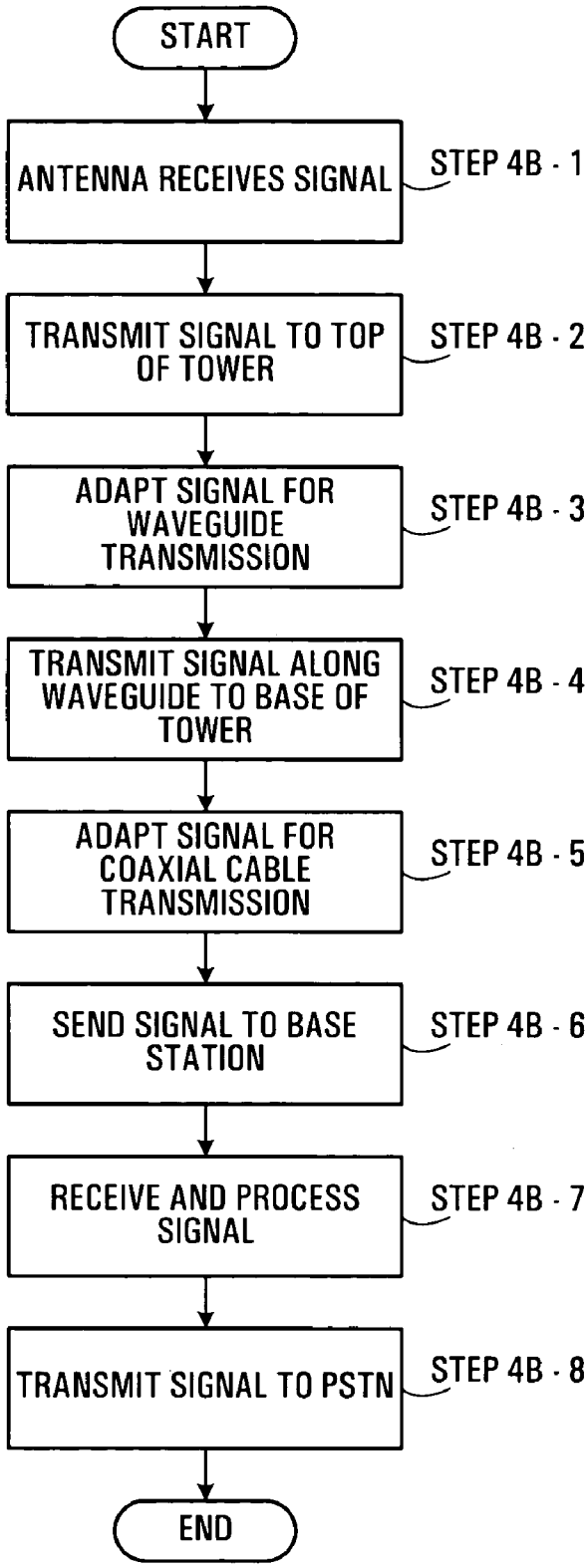
FIG. 4B is a flow diagram of the operation of the cellular base station system of FIG. 2 to receive a cellular signal.

FIGS. 4A and 4B provide flowcharts of the operation of the system 40 of FIG. 2. Considering FIG. 4A, FIG. 4A is a flowchart of the transmission of a signal from the PSTN to one of the antennas 54. The operation, as shown in the flowchart, begins with "START". In step 4A-1, the signal is received by the base station 46 from the PSTN. In step 4A-2, the signal is processed by the base station 46. In step 4A-3, the signal is transmitted to the base of one of the legs 50 of the tower 48 over the corresponding coaxial cable 60. In step 4A-4, the signal is adapted for waveguide transmission by the corresponding adapter 62. In step 4A-5, the signal is transmitted through the waveguide of the leg 50 from the bottom to the top of the tower 48. In step 4A-6, the signal is adapted for coaxial cable transmission by the adapter 58. In step 4A-7, the signal is transmitted to the antenna 54 over the coaxial cable 56. In step 4A-8, the signal is radiated from the antenna 54. The operation is then complete as represented by "END" in the flowchart.

FIG. 4B charts the reception of the signal by the system 40. The operation, as shown in the flowchart, begins with "START". In step 4B-1, one of the antennas 54 receives the signal. In step 4B-2, the antenna 54 transmits the signal over the corresponding coaxial cable 56 to the adapter 58 at the top of tower 48. In step 4B-3, the adapter 58 adapts the signal for waveguide transmission. In step 4B-4, the signal is transmitted along the waveguide of the leg 50 to the base of the tower. In step 4B-5, the signal is adapted for coaxial cable transmission by the adapter 62. In step 4B-6, the signal is transmitted to the base station 46 by the coaxial cable 60. In step 4B-7, the signal is processed by the base station 46. In step 4B-8, the signal is transmitted to the PSTN by the transceiver 42. The operation is then complete as represented by "END" in the flowchart.

Although the embodiment depicted in FIGS. 4A and 4B include the steps of adapting the signals from coaxial cable transmission to waveguide transmission, the system 40 may alternatively be designed with all or partial waveguide components which will allow the elimination of some or all of the adapters 58 and 62.

The present invention also encompasses other structural supports incorporating waveguides, such as beams within buildings.

The above description of embodiments should not be interpreted in any limiting manner since variations and refinements can be made without departing from the invention. The scope of the invention is defined by the appended claims and their equivalents.

We claim:

1. A leg for a communications tower having an interior surface, the interior surface defining at least one waveguide suitable for transmitting communication signals.

2. The leg according to claim 1 wherein the leg is segmented and the segments are coupled such that each waveguide is continuous.

3. The leg according to claim 2 wherein the segments terminate in flanges by which successive segments are connected.

4. The leg according to claim 1 wherein the leg is hermetically sealed.

5. The leg according to claim 1 further comprising a first waveguide adapter at a first location on the leg and a second waveguide adapter at a second location spaced apart from the first location on the leg wherein the at least one waveguide comprises a first waveguide and the first waveguide extends between the first and second locations and the first and second waveguide adapters are operable to transform the communication signals to and from a waveguide form.

6. The leg according to claim 5 wherein the first and second waveguide adapters are operable to mate with coaxial cable.

7. The leg according to claim 1 further comprising a waveguide adapter at a first location on the leg and a waveguide coupler at a second location spaced apart from the first location on the leg wherein the at least one waveguide comprises a first waveguide and the first waveguide extends between the first and second locations and the waveguide adapter is operable to transform the communication signals to and from a waveguide form.

8. The leg according to claim 7 further comprising an antenna adapted to mate with the waveguide coupler.

9. The leg according to claim 1 wherein the at least one waveguide is a circular waveguide with an interior diameter of 4.511 inches±0.005 inches.

10. The leg according to claim 1 wherein the at least one waveguide is dimensioned to carry a signal of 1700 MHz to 2600 MHz.

11. A communications tower comprising at least one leg according to claim 1.

12. The communications tower according to claim 11 wherein the at least one waveguide comprises two waveguides.

13. The communications tower according to claim 11 wherein the communications tower is a cellular base station tower.

14. The communications tower according to claim 11 wherein the at least one leg comprises a first leg and a second leg and the at least one waveguide defined by the first leg comprises one waveguide and the at least one waveguide defined by the second leg comprises two waveguides.

15. The leg according to claim 1 wherein the at least one waveguide is a rectangular waveguide with an interior cross-section of 4.300 inches±0.005 inches by 2.150 inches±0.005 inches.

16. A method of transmitting a signal from a first end of a communications tower leg to a second end of the tower leg comprising:

transmitting the signal along a waveguide, suitable for transmitting communication signals, and defined by an interior of the communications tower leg, from the first end to the second end, transforming the signal into a waveguide form at the first end; and transforming the signal from the waveguide form at the second end.

17. The method of claim 16 further comprising:

receiving the signal at the first end from a public switched telephone network.

18. The method of claim 17 further comprising radiating the signal transformed from the waveguide form from the second end.

19. A method of providing a signal path through a communications lower leg comprising:

providing a waveguide, suitable for transmitting communication signals, and defined by an interior of the leg; and providing a respective signal adapter adjacent each end of the leg.

20. An arrangement comprising at least one leg having an interior surface, the interior surface defining at least one waveguide suitable for transmitting communications signals, and an antenna supported at an elevated position by the at least one leg.

* * * * *